US005956929A

United States Patent [19]

Yisha et al.

[11] Patent Number: 5,956,929

[45] Date of Patent: Sep. 28, 1999

[54] PACKAGING SYSTEM FOR THE TUBE STOCK CONTINUOUS FILM MEDIA

[75] Inventors: Richard Yisha, Strongsville; Laura Lathem; John Lathem, both of Fairview Park; Dennis Leonard, Parma, all of Ohio; Derek Baggs, Rockford, Ill.

[73] Assignee: I.D. Images, Inc., Strongsville, Ohio

[21] Appl. No.: 08/844,006

[22] Filed: Apr. 18, 1997

[51] Int. Cl.[6] ..... B65B 7/06; B65B 9/13; B65B 43/36

[52] U.S. Cl. ..... 53/459; 53/567; 53/385.1

[58] Field of Search ..... 53/456, 452, 459, 53/468, 469, 558, 567, 564, 385.1, 451, 450, 553, 554, 555

[56] References Cited

U.S. PATENT DOCUMENTS

| | | | |
|---|---|---|---|
| 3,481,102 | 12/1969 | Dolman | 53/459 |
| 3,536,005 | 10/1970 | Derrickson | 101/129 |
| 3,594,978 | 7/1971 | Spitznagel | 53/183 |
| 3,650,207 | 3/1972 | Black | 101/115 |
| 3,774,367 | 11/1973 | Lerner | 53/67 |
| 3,815,318 | 6/1974 | Lerner | 53/29 |
| 3,878,776 | 4/1975 | Schneider | 101/41 |
| 3,882,656 | 5/1975 | Lerner | 53/29 |
| 3,912,145 | 10/1975 | Meihofer | 226/44 |
| 3,945,317 | 3/1976 | Brasa | 101/124 |
| 3,973,489 | 8/1976 | Black | 101/115 |
| 3,973,492 | 8/1976 | Black et al. | 101/126 |
| 4,307,661 | 12/1981 | Wilkins et al. | 101/93 |
| 4,307,662 | 12/1981 | Mitter | 101/123 |
| 4,346,546 | 8/1982 | Tasker | 53/412 |
| 4,365,551 | 12/1982 | Horton | 101/124 |
| 4,586,318 | 5/1986 | Litt et al. | 53/459 |
| 4,730,437 | 3/1988 | Benno | 53/459 X |
| 4,765,121 | 8/1988 | Konstantin et al. | 53/459 X |
| 4,782,751 | 11/1988 | Colapinto | 101/126 |
| 4,819,556 | 4/1989 | Abe et al. | 101/93 |
| 5,050,497 | 9/1991 | Klemm | 101/124 |
| 5,092,239 | 3/1992 | Bubley | 101/115 |
| 5,099,736 | 3/1992 | Evers | 53/459 X |
| 5,142,980 | 9/1992 | Bottger | 101/233 |
| 5,289,770 | 3/1994 | Hern | 101/226 |
| 5,345,863 | 9/1994 | Kurata et al. | 101/126 |

FOREIGN PATENT DOCUMENTS

| | | |
|---|---|---|
| 1 505 201 | 10/1967 | France . |
| 2 079 851 | 2/1970 | France . |
| 2 425 983 | 5/1979 | France . |

OTHER PUBLICATIONS

Sharp Packaging, Inc., *The Sharp Programmable Imprinter Operation Instructions.* (No Date).

Sharp Packaging Systems, Inc., *The Sharp One Packaging System User Guide*, 1992.

Automated Packaging Systems, *The Total Systems Approach to Packaging Productivity*, 1996.

*Primary Examiner*—James F. Coan

*Attorney, Agent, or Firm*—Benesch, Friedlander, Coplan & Aronoff LLP

[57] ABSTRACT

A packaging system (10) for tube stock continuous film media (20). The system forms a bag, fills the bag with product, and seals the bag. A floating platen (30) is used to separate the two layers of the tube stock continuous film media during processing. The system is suitable with a wide variety of different types of media, and forms an aesthetically pleasing package.

33 Claims, 3 Drawing Sheets

PACKAGING SYSTEM FOR THE TUBE STOCK CONTINUOUS FILM MEDIA

FIELD OF INVENTION

The present invention relates generally to a packaging system, and more particularly to a packaging system suitable for tube stock continuous film media.

BACKGROUND OF THE INVENTION

For many types of media (e.g., low density polyethylene) a packaging process employing such media is typically performed using a conventional bagging machine. In this regard, the media is preprocessed as bags on a roll with perforations between the top of one bag and the bottom of an adjacent bag. In this way the perforations allow for separation of individual bags. A typical packaging system for bags on a roll operates in the following manner: (1) bags on the roll are advanced such that the bag can be blown open and filled by an operator or infeed device, and (2) the filled bag is sealed and separated from the roll at the perforation. Thereafter, the packaging system advances the bag stock to repeat the foregoing process.

It is often desired to provide packaging for a product using a media which is not suitable for arrangement as a bag on a roll. In this regard, many desirable types of media are not well suited to being perforated (e.g., metalized polyester and polypropelene and other films), or are too costly to have preprocessed in the form of a bag on a roll. Accordingly, these types of media are provided in the form of a continuous film. Earlier devices for packaging a product using these types of media (1) form a bag from a single sheet media, (2) fill the bag with product, and (3) seal the bag. There are numerous drawbacks to these devices. First, these devices waste a large amount of media because they form "fins" along the length of the bag in order to properly seal the bag. Moreover, the "fin" protrudes from the bag, thus providing a less aesthetically pleasing package. Another drawback to the earlier devices is their large weight and size. In this regard, a typical earlier device will weigh in the range of approximately 300 to 400 lbs., and have a length of 6 to 7 feet. In addition, such earlier devices are fairly expensive. Such devices generally cost $40,000 or more. Accordingly, there is a need for an efficient and inexpensive system for packaging products using media which is not preprocessed in the form of a bag on a roll.

SUMMARY OF THE INVENTION

According to the present invention there is provided a packaging system for forming, filling and sealing bags by processing a continuous film media in the form a tube.

An advantage of the present invention is the provision of a packaging system for a continuous film media which is efficient and inexpensive.

Another advantage of the present invention is the provision of a packaging system for a continuous film media which produces aesthetically pleasing packaging.

Another advantage of the present invention is the provision of a packaging system which is suitable for producing bag packaging with a wide variety of different types of media.

Another advantage of the present invention is the provision of a packaging system for a continuous film media which minimizes waste of the media.

Still another advantage of the present invention is the provision of a packaging system that can generate packaging of varying length from the same media stock.

Still another advantage of the present invention is the provision of a packaging system for a continuous film media which weighs under 80 lbs.

Still another advantage of the present invention is the provision of a packaging system for a continuous film media which can fit on a desktop.

Yet another advantage of the present invention is the provision of a packaging system for a continuous film media which costs significantly less than earlier packaging devices which use continuous film media.

Yet another advantage of the present invention is the provision of a packaging system for a continuous film media which can be easily produced by modifying existing bagging systems.

Still other advantages of the invention will become apparent to those skilled in the art upon a reading and understanding of the following detailed description, accompanying drawings and appended claims.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENT

Figure 1:
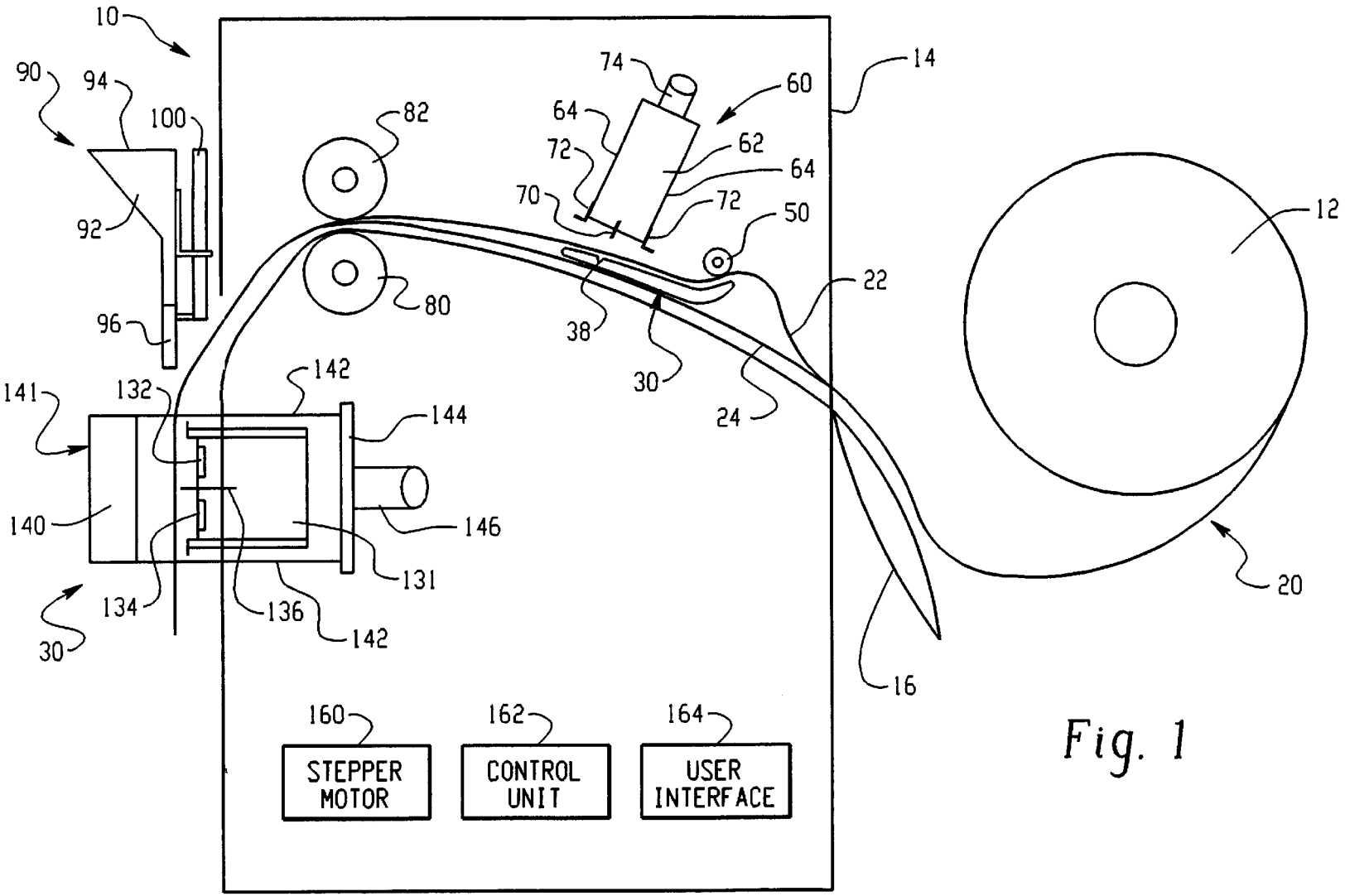
FIG. 1 is a schematic side view of a preferred embodiment of the present invention.

Referring now to the drawings wherein the showings are for the purposes of illustrating a preferred embodiment of the invention only and not for purposes of limiting same, FIG. 1 shows a schematic side view of packaging system 10, according to a preferred embodiment of the present invention. Packaging system 10 includes a supply role 12, which provides a supply of continuous film media 20 (e.g., metalized polyester). It should be noted that tube stock is the preferred form of media 20 for use with packaging system 10. In this respect, media 20 is comprised of two plies of sheet media (i.e., an upper layer and a lower layer), which are fuse together only at the peripheral edges thereof (i.e., at the two side edges). Accordingly, media 20 forms a hollow tube. Top and bottom seals, which are needed to complete a bag package, are provided by packaging system 10, as will be explained below. It should be appreciated that media 20 may also take the form of a uniform tubular sheet media having no seals, or one or more seals at the peripheral edges thereof.

Figure 2:
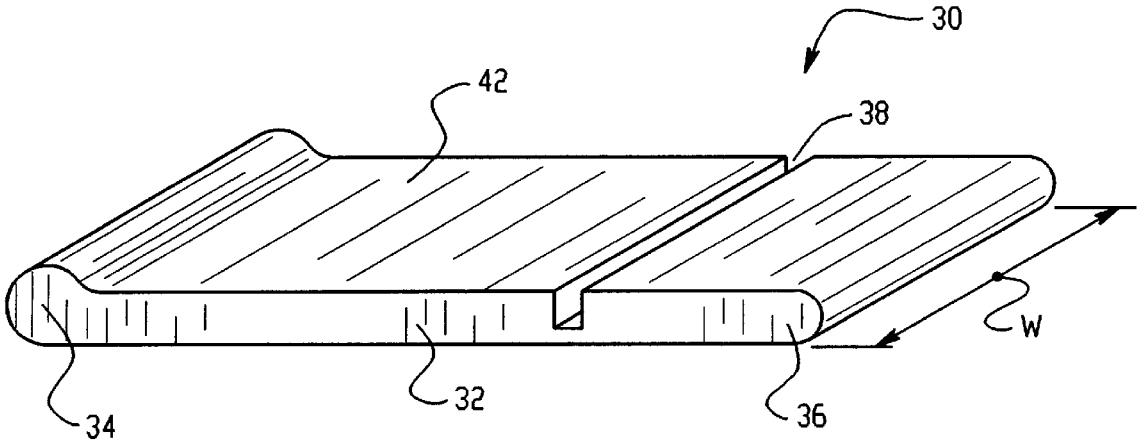
FIG. 2 is an enlarged perspective view of a floating platen shown in FIG. 1.

Before media 20 is fed into housing 14 of packaging system 10, a puck or floating platen 30 is inserted into the tube formed by media 20 in order to isolate the upper layer from the lower layer during a cutting operation. Accordingly, floating platen 30 is inserted between the upper and lower layers of media 20. Floating platen 30 will now be described with reference to FIG. 2. Floating platen 30 is comprised of a generally planar rectangular main body portion 32 and a protruding tail portion 34. Main body portion 32 preferably has a rounded front end 36. A groove 38 is formed on the upper surface 42 of main body portion 32. Groove 38 is generally perpendicular to the longitudinal axis of floating platen 30, and is dimensioned to receive the edge of a blade to cut one layer of media 20, as will be explained below. Tail portion 34 is located at the rear end of main body portion 32 and protrudes outward from upper surface 42. Tail portion 34 is provided to restrict the movement of floating platen 30, as will be explained below. Floating platen 30 is dimensioned to be received within the tube formed by media 20. In this regard, floating platen has a width W dependent upon the width of the media 20. For instance, if media 20 has a 4 inch width, floating platen 30 should have a width W of nearly 4 inches.

It should be appreciated that floating platen 30 is inserted into the tube formed by media 20, such that the front end of floating platen 30 is facing the open end of the tube and tail portion 34 is facing the inner end of the tube towards supply roll 12 (see FIG. 1).

Ramp 16 provides a support and guide surface for media 20 as it moves along a processing path including a locating roller 50, a cutter block 60, a drive roller 80, a guide roller 82, a funnel assembly 90 and a seal and cut assembly 130. A housing 14 houses locating roller 50, cutter block 60, drive roller 80, guide roller 82, and seal and cut assembly 130.

Locating roller 50 is a free roller which is used to locate floating platen 30, and to guide the upper layer of media 20 over upper surface 42 of floating platen 30. Locating roller 50 locates floating platen 30 by trapping tail portion 34 of platen 30, as shown in FIG. 1. In addition, locating roller 50 allows media 20 to continue along the processing path by permitting media 20 to flow around platen 30. A complete description of the operation of packaging system 10 will be provided below.

Figure 3:
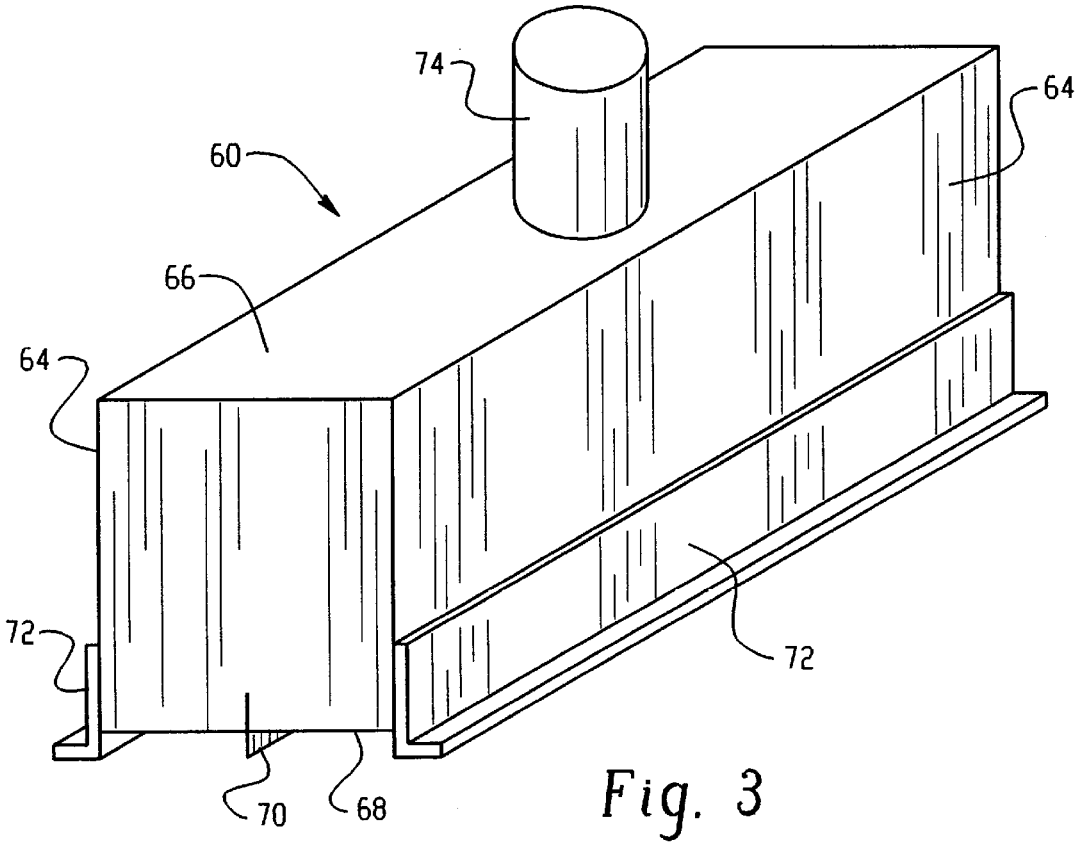
FIG. 3 is an enlarged perspective of a cutter block shown in FIG. 1.

Cutter block 60 is provided to cut the upper layer of media 20 in order to form a top opening of a bag, as will be explained in detail below. Referring now to FIG. 3, there is shown an enlarged perspective view of cutter block 60. Cutter block 60 is generally comprised of a central body 62, a serrated blade 70, a pair of spring loaded L-shaped pressure feet 72, and a pneumatic actuator 74. Central body 62 includes side faces 64, top face 66 and bottom face 68. L-shaped pressure feet 72 are mounted to side faces 64. It should be appreciated that springs (not shown) bias pressure feet 72 downward in the position shown in FIG. 3. Blade 70 is mounted to bottom face 68, along the longitudinal axis of cutter block 60. It should be noted that blade 70 is preferably serrated (rather than straight) in order to prolong the life of the blade, provide a clean cut with less pressure, and allow for the possibility of forming a perforated cut. Pneumatic actuator 74 is generally comprised of an air cylinder/piston arrangement. Pneumatic actuator 74 is provided to move cutter block 60 upward and downward. When cutter block 60 is moved downward, blade 60 contacts the upper layer of media 20 and makes a cut therein to form a top opening of a bag. Pressure feet 72 hold media 20 in tension against upper surface 42 of platen 30, as blade 60 cuts the upper layer of media 20. It should be appreciated that blade 60 is received within groove 38 of platen 30 as it cuts the upper layer of media 20.

Drive roller 80 is driven by a stepper motor 160, and advances media 20 through the processing path. Drive roller 80 is preferably formed of rubber. Guide roller 82 is a free roller which operates in conjunction with drive roller 80 to advance media 20. Accordingly, drive roller 80 applies a tension to the upper layer of media 20, while guide roller 82 applies an equivalent tension to the lower layer of media 20. Guide roller 82 is preferably aluminized.

Figure 5:
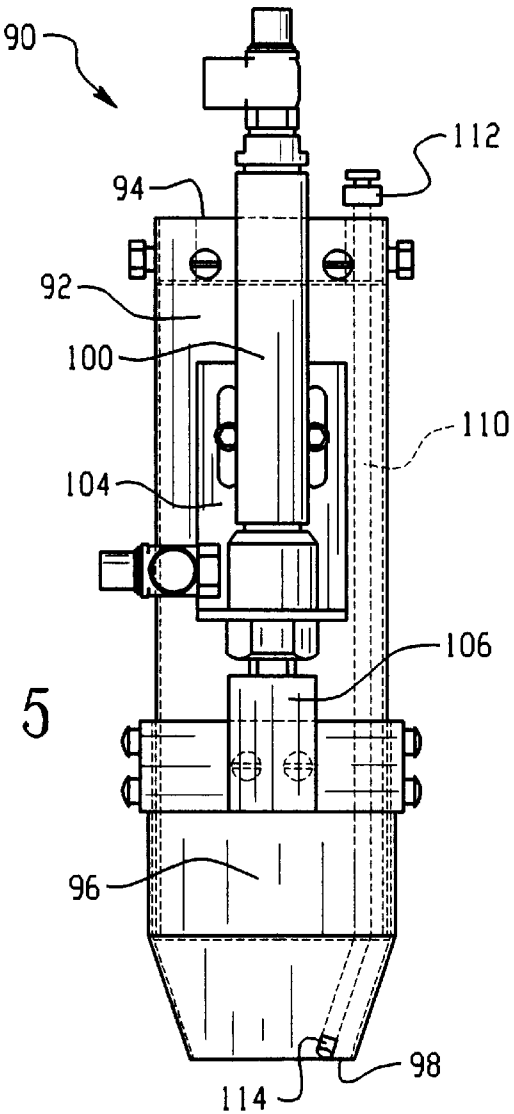
FIG. 5 is an enlarged front view of the funnel assembly shown in FIG. 4.
Figure 4:
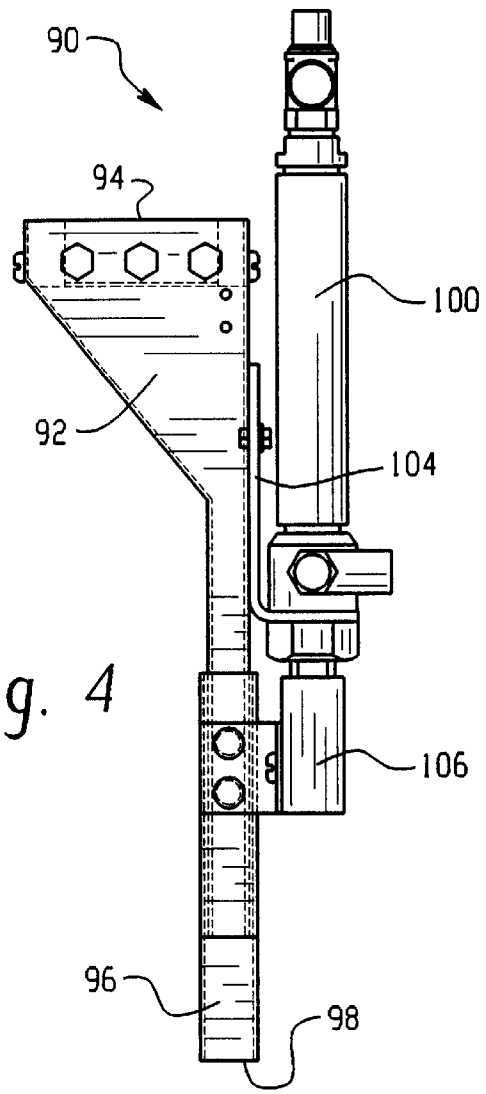
FIG. 4 is an enlarged side view of a funnel assembly shown in FIG. 1.

Referring now to FIGS. 4 and 5, there is shown a pneumatic funnel assembly 90, which is provided to both open a bag and fill the bag with product. Pneumatic funnel assembly 90 is generally comprised of a fixed funnel portion 92, a telescoping funnel portion 96, an air cylinder/piston 100, and an air tube 110. Fixed funnel portion 92 includes a top end 94 for receiving product to be placed into the bag. Telescoping funnel portion 96 includes an outlet 98, and is movable relative to fixed funnel portion 92. As telescoping funnel portion 96 is moved downward, it moves into the opening of the bag, as will be explained below. Product exits funnel assembly 90 through outlet 98. An L-shaped mounting bracket 104 is provided to mount air cylinder/piston 100 to fixed funnel portion 92. A mounting bracket 106 is used to attach the piston portion of air cylinder/piston 100 to telescoping funnel portion 96.

Air tube 110 extends along the inside of funnel portions 92 and 96. However, it should be noted that air tube 110 remains fixed relative to funnel portion 92. Air tube 110 includes a tube fitting 112 and a nozzle 114. Tube fitting 112 is provided at the top end of air tube 110 for connection to a blower. Nozzle 114 is provided at the bottom end of air tube 110. Nozzle 114 guides air (or other gas) into the bag, as will be explained below.

It should be appreciated that funnel assembly 90, as shown in FIG. 1, is attached to an infeed or product dispensing device (not shown). However, funnel assembly 90 is also suitably attached to housing 14.

Seal and cut assembly 130 is generally comprised of a block 131 and a pressure bar assembly 141 (FIG. 1). Block 131 is similar in structure and operation to cutter block 60. In this respect, block 131 includes spring-loaded L-shaped pressure feet 138 and a serrated blade 136. Serrated blade 136 is provided to cut the lower layer of media 20 to separate a completely formed bag from the roll of media. L-shaped pressure feet 130 hold media 20 in tension against pressure bar 140, which is described below. This tension aids the cutting of media 20 and improves the quality of the seals formed therein. Block 131 also includes an upper heater bar 132 and a lower heater bar 134. Heater bars 132, 134 preferably take the form of cylindrical cartridge heaters, which are mounted in block 131. Cartridge heaters typically have a coiled resistance wire and a stainless steel shell, with dimensions of 0.25 inch (diameter) and 4.5 inches (length). Upper heater bar 132 fuses the upper and lower layers of media 20 to form the bottom seal of a bag package, while lower heater bar fuses the upper and lower layers of media 20 to form the top seal of a bag package. It should be noted that media 20 is typically heated to a temperature in the range of 250–400 degrees F to form the seals. A complete description of the operation of packaging system 10 is provided below.

Pressure bar assembly 141 is generally comprised of a pressure bar 140, arms 142, bar 144 and pneumatic actuator 146. Pressure bar 140 applies pressure to media 20 such that it is simultaneously pressed against blade 136 and upper and lower heat bars 132, 134. As a result two seals and a cut are performed at the same time, as will be explained below. It should be noted that pressure bar 140 preferably includes a rubber pad that facilitates a good seal and accommodates protruding blade 136. A pair of arms 142 attach pressure bar 140 to bar 144. Bar 144 is moved inward and outward by pneumatic actuator 146. Pneumatic actuator 146 is comprised of an air cylinder/piston arrangement.

Operation of packaging system 10 is controlled by an electronic control unit 162, which preferably includes a microprocessor. Electronic control unit 162 is programmable via a user interface 164, which preferably includes a keypad, control panel, or the like. It should be appreciated that control unit 162 is programmable to operate in coordination and in communication with a product dispensing device for dispensing product to funnel assembly 90.

The operation of packaging system 10 will now be described in detail with reference to FIG. 1. First, floating platen 30 is inserted into the tube formed by the two layers of media 20. Next, media 20 is fed into the rear of housing 14 and between rollers 80 and 82. As media 20 is pulled forward along ramp 16 by roller 80, roller 50 will prohibit floating platen 30 from advancing forward. Accordingly, floating platen will remain in a fixed position relative to ramp 16. However, the upper and lower layers of media 20 are free to flow around floating platen 30. In this regard, the lower layer will flow beneath platen 30, while the upper layer will flow over the top of platen 30. Stepper motor 160 advances media 20 a predetermined distance past cutter block 60 and temporarily stops further advancement. The predetermined distance will determine the length size of the bag. Cutter block 60 is moved downward to contact blade 70 with the upper layer of media 20 in order to form the top opening of a bag. As indicated above, blade 70 is received within groove 38 of platen 30 and pressure feet 72 apply tension to media 20 while the upper layer is being cut. Thereafter, cutter block 30 is retracted, and stepper motor 160 advances media 20. Media 20 is advanced such that the position of the foregoing cut is aligned with blade 136. In this position, telescoping funnel portion 96 of funnel assembly 90 is lowered into the newly formed bag opening, and air exiting nozzle 114 of air tube 110 is blown into the bag to open the bag to receive product. Product is then placed into the bag through funnel portions 92 and 96. Next, telescoping funnel portion 96 is retracted and pressure bar 140 is moved into contact with media 20 to simultaneously press it against upper and lower heater bars 132,134 and blade 136. As a result, a "bottom" seal is provided for the next bag to be filled with product, a "top" seal is provided for the bag which has just been filled with product, and this newly formed bag is separated from the media stock. The "top" and "bottom" seals are oriented transverse to the peripheral side seals, and are preferably at least 0.5 inches thick in order to provide a high quality seal for use with barrier films. Barrier films are often used in food packaging. It should be understood that on the very first run through the processing path, the first bag will be discarded, since it will not have a bottom seal prior to filling with product.

The invention has been described with reference to a preferred embodiment. Obviously, modifications and alterations will occur to others upon a reading and understanding of this specification. For instance, the floating platen could be replace by a vacuum for pulling the lower layer of the media down into or below the ramp, while the top layer is being cut. However, this approach is not deemed to yield results which are superior to the preferred embodiment. Moreover, the present invention could be modified to accommodate optics electronics for registering an I-mark or the like appearing on the media. Accordingly, the advancement of the media by the stepper motor could be determined by signals generated by the optics electronics. It is intended that all such modifications and alterations be included insofar as they come within the scope of the appended claims or the equivalents thereof.

Having thus described the invention, it is now claimed:

1. A packaging system for forming, filling and sealing a bag formed from an associated continuous film media having a generally continuous first layer portion and a generally continuous second layer portion, said first and second layer portions being sealed together at the peripheral side edges thereof to form a tube, the packaging system comprising:

media advancement means adapted for advancing the associated media through a processing path;

first sealing means adapted for forming a first seal between said first and second layer portions in a direction transverse to the peripheral side edges, said first seal defining a bottom of the bag;

isolation means adapted for isolating the first layer portion from the second layer portion;

first cutting means adapted for cutting the first layer portion in a direction transverse to the peripheral side edges while the first layer portion is isolated from the second layer portion by the isolation means;

blower means adapted for directing a gas into the bag, to open the bag for insertion of a product therein;

second sealing means adapted for forming a second seal between said first and second layer portions in a direction transverse to the peripheral side edges, said second seal defining a top of the bag;

second cutting means adapted for cutting at least the second layer portion in a direction transverse to the peripheral side edges to separate the bag from the associated media, wherein said second cutting means is located between said first and second sealing means.

2. A system according to claim 1, wherein said isolation means is located inside the tube between said first and second layer portions, said isolation means including a tail member for fixing the position of the isolation means relative to said first cutting means.

3. A packaging system according to claim 1, wherein said first cutting means includes a blade.

4. A packaging system according to claim 3, wherein said isolation means includes a groove for receiving said blade.

5. A packaging system according to claim 1, wherein said first and second sealing means include a heating means.

6. A packaging system according to claim 1, wherein said system further comprises a bar means for placing said media in contact with said first and second seal means.

7. A packaging system according to claim 1, wherein said first sealing means, said second sealing means, and said second cutting means simultaneously contact said media.

8. A packaging system according to claim 1, wherein said media advancement means includes a motor for advancing the associated media a predetermined distance past first cutting means to establish a length of said bag.

9. A packaging system according to claim 1, wherein said first cutter means includes a pneumatic actuator.

10. A packaging system according to claim 1, wherein said first cutter means includes tension means for applying tension to said media as said first cutter means cuts the first layer portion.

11. A packaging system according to claim 2, wherein said media advancement means includes a locating roller that engages with said tail member to restrict movement of said isolation means along said processing path.

12. A packaging system according to claim 1, wherein said isolation means has a width equal to or less than the width of the media.

13. A packaging system according to claim 1, wherein at least one of said first and second layer portions is a high barrier film.

14. A packaging system according to claim 13, wherein said high barrier film is a metalized film.

15. A method for forming, filling and sealing a bag formed from an associated continuous film media having a generally continuous first layer portion and a generally continuous second layer portion, said first and second layer portions adaptable to form a tube, the method comprising the steps of:

advancing the associated media through a processing path;

forming a first seal between said first and second layer portions in a direction transverse to the peripheral side edges, said first seal defining a bottom of the bag;

isolating the first layer portion from the second layer portion;

cutting the first layer portion in a direction transverse to the peripheral side edges while the first layer portion is isolated from the second layer portion;

blowing a gas into the bag to open the bag for insertion of a product therein;

forming a second seal between said first and second layer portions in a direction transverse to the peripheral side edges, said second seal defining a top of the bag; and cutting at least the second layer portion between a first seal and a second seal, in a direction transverse to the peripheral side edges from the associated media to separate the bag from the associated media.

16. A method according to claim 15, wherein said step of advancing the associated media through the processing path includes the step of advancing the associated media a predetermined distance through the processing path to establish a length of said bag.

17. A method according to claim 15, wherein said step of forming the first seal includes the step of applying heat to said first and second layer portions.

18. A method according to claim 15, wherein said step of forming the second seal includes the step of applying heat to said first and second layer portions.

19. A method according to claim 15, wherein said steps of forming said first and second seals includes the step of applying pressure to the media.

20. A method according to claim 15, wherein said steps of forming a first seal, forming a second seal, and cutting the second layer portion are performed simultaneously.

21. A method according to claim 15, wherein said media is advanced through said processing path in predetermined increments.

22. A method according to claim 15, wherein tension is applied to the media during said step of cutting the first layer portion.

23. A method according to claim 15, wherein tension is applied to the media during said steps of forming a first seal, forming a second seal, and cutting the second layer portion.

24. A method according to claim 15, wherein at least one of said first and second layer portions is a high barrier film.

25. A method according to claim 24, wherein said high barrier film is a metalized film.

26. A packaging system for forming, filling and sealing a bag formed from an associated continuous film media having a generally continuous first layer portion and a generally continuous second layer portion, the packaging system comprising:

media advancement means for advancing the associated media through a processing path;

isolation means adapted for isolating the first layer portion from the second layer portion;

first cutting means for cutting the first layer portion in a direction transverse to the peripheral side edges while the first layer portion is isolated from the second layer portion by the isolation means;

dispensing means for dispensing a product into the bag;

first sealing means for forming a first seal between said first and second layer portions in a direction transverse to the peripheral side edges, said first seal defining a bottom portion of a first bag;

second sealing means for forming a second seal between said first and second layer portions in a direction transverse to the peripheral side edges, said second seal defining a top portion of a second bag;

second cutting means for cutting at least the second layer portion in a direction transverse to the peripheral side edges to separate the bottom portion of the first bag from the top portion of the second bag.

27. A packaging system according to claim 26, wherein said system further comprises a blower means integrated with said dispensing means for blowing a gas into the bag to facilitate the dispensing of the product into the bag by said dispensing means.

28. A packaging system according to claim 26, wherein said packaging system further includes blower means for blowing a gas into the bag to facilitate the dispensing of the product into the bag by said dispensing means.

29. A packaging system according to claim 26, wherein said media advancement means includes a motor for advancing the associated media a predetermined distance past said first cutting means to establish a length of said bag.

30. A packaging system according to claim 26, wherein said media advancement means is responsive to signals generated by optics electronics for determining a distance for advancing the associated media past said first cutting means, to establish a bag length.

31. A packaging system according to claim 26, wherein at least one of said first and second layer portions is a high barrier film.

32. A packaging system according to claim 31, wherein said high barrier film is a metalized film.

33. A packaging system according to claim 26, wherein said dispensing means includes a telescoping funnel means.

* * * * *